US011590051B2

(12) United States Patent
Piucci, Jr. et al.

(10) Patent No.: US 11,590,051 B2
(45) Date of Patent: Feb. 28, 2023

(54) GENTLE MASSAGE AND MYOFASCIAL RELEASE DEVICE

(71) Applicants: Vincent A Piucci, Jr., Oakham, MA (US); Barbara A Piucci, Oakham, MA (US)

(72) Inventors: Vincent A Piucci, Jr., Oakham, MA (US); Barbara A Piucci, Oakham, MA (US)

( * ) Notice: Subject to any disclaimer, the term of this patent is extended or adjusted under 35 U.S.C. 154(b) by 352 days.

(21) Appl. No.: 16/665,003

(22) Filed: Oct. 28, 2019

(65) Prior Publication Data

US 2020/0138666 A1 May 7, 2020

Related U.S. Application Data

(60) Provisional application No. 62/756,148, filed on Nov. 6, 2018.

(51) Int. Cl.
*A61H 15/00* (2006.01)
*A61H 39/04* (2006.01)

(52) U.S. Cl.
CPC ..... *A61H 15/0092* (2013.01); *A61H 39/04* (2013.01); *A61H 2015/0021* (2013.01); *A61H 2203/03* (2013.01)

(58) Field of Classification Search
CPC .... A61H 7/003; A61H 15/00; A61H 15/0078; A61H 15/0085; A61H 15/0098; A61H 15/02; A61H 2015/0007; A61H 2015/0014; A61H 2015/0021; A61H 2015/0028; A61H 2015/0035; A61H 2015/0042; A61H 2015/0057; A61H 2015/0064; A61H 2015/0071; A61H 39/02; A61H 39/04; A61H 2201/169; A61H 2201/0153
USPC ..... 15/236.03
See application file for complete search history.

(56) References Cited

U.S. PATENT DOCUMENTS 916,637 A * 3/1909 Wallen ..... A61H 7/003 601/135
1,671,019 A * 5/1928 Falck ..... A61H 15/0092 601/125
1,910,490 A * 5/1933 Lucas ..... A61H 15/0092 601/123
2,572,627 A * 10/1951 Kelly ..... A61H 15/0092 601/125
2,607,064 A * 8/1952 Sullivan ..... A46D 1/00 15/187

(Continued)

OTHER PUBLICATIONS

Hand Massage Roller in Wood, Nov. 7, 2018 https://www.souvnear.com/bulk-wholesale-hand-massage-roller-in-rosewood-6-5-handcrafted-wheel-massager-acupressure-back-legs.

(Continued)

*Primary Examiner* — Colin W Stuart
*Assistant Examiner* — Douglas Y Sul

(57) ABSTRACT

A massage device provides a gentle massage and myofascial release. The massage device comprises a first roller set and a second roller set that are configured so that the first roller set makes a first contact that displaces the tissue being massaged and, prior to the tissue returning to its natural state, the second roller makes a second contact with the tissue being massaged, thus providing a deeper, extended massage to the tissue. Also disclosed is an ergonomic handle for a massage device that also functions as a trigger point release tool.

14 Claims, 22 Drawing Sheets

(56) References Cited

U.S. PATENT DOCUMENTS

| | | | | | |
|---|---|---|---|---|---|
| 3,060,928 | A * | 10/1962 | Lowe | A61H 15/0092 | 601/128 |
| 3,756,224 | A * | 9/1973 | Laymon | A61H 15/0092 | 601/125 |
| 4,481,939 | A * | 11/1984 | Mabuchi | A61H 15/0085 | 601/118 |
| 4,813,404 | A * | 3/1989 | Vallis | A45D 40/28 | 601/125 |
| 4,945,900 | A * | 8/1990 | Masuda | A61H 15/0092 | 601/120 |
| 5,676,638 | A | 10/1997 | Shefi | | |
| 6,315,742 | B1 | 11/2001 | Howard | | |
| 6,726,640 | B2 | 4/2004 | Ching-Chen | | |
| 6,881,195 | B2 | 4/2005 | Wu | | |
| 6,926,683 | B1 * | 8/2005 | Kochman | A61H 7/008 | 601/118 |
| 6,966,883 | B2 | 11/2005 | Pidcock | | |
| 7,998,097 | B2 | 8/2011 | Gueret | | |
| 9,649,244 | B1 * | 5/2017 | Jacobs | A61H 7/001 | |
| 9,693,929 | B2 | 7/2017 | Faussett | | |
| 9,839,575 | B2 | 12/2017 | Slocum et al. | | |
| 9,901,508 | B2 | 2/2018 | Fitzmaurice | | |
| 10,039,690 | B2 | 8/2018 | Kramer | | |
| 2002/0147418 | A1 * | 10/2002 | Huang | A61H 7/003 | 601/137 |
| 2007/0270727 | A1 * | 11/2007 | Khorassani Zadeh | A61H 1/008 | 601/134 |
| 2013/0090582 | A1 * | 4/2013 | Bertram | A61H 15/0092 | 601/119 |
| 2020/0060924 | A1 * | 2/2020 | Thornburg | A61H 1/008 | |

OTHER PUBLICATIONS

Hot Mini 8 Wheels Massage Roller Body Arms Legs Massager, Nov. 6, 2018 https://www.massagesupplies.com/product/12143/.

Two Wheel Massage Roller, Nov. 6, 2018 http://www.zenathletics.com/products/for-men/two-wheel-massager-wte10628.php.

* cited by examiner

GENTLE MASSAGE AND MYOFASCIAL RELEASE DEVICE

RELATED APPLICATIONS

This application claims the benefit of U.S. Provisional Patent Application No. 62/756,148 filed Nov. 6, 2018, entitled Gentle Massage and Myofascial Release Device, the contents and teachings of which are hereby incorporated by reference in their entirety.

BACKGROUND

Massage is an ancient art that is practiced in most cultures around the world. The earliest evidence of the practice dates back to at least 2300 BC. Equine massage was documented in ancient Greece, where horses were massaged prior to battle and during Olympic games as a way to improve their performance. Canine massage is also very old. Julius Caesar was known to have travelled with a personal massage therapist who also massaged his war dogs.

Over the last number of decades, massage has gained widespread acceptance as a therapeutic treatment. This is particularly true in the sports world where terms such as Sports Massage and Equine Sports Massage Therapy have gained common usage. Sports massage is the application of therapeutic massage techniques to relieve sore muscles, reduce and relax muscle spasms and knots, prevent injuries, release endorphins, enhance proprioception, increase flexibility and range of motion, and improve athletic performance. This is in contrast to traditional massage, such as Swedish massage, which is best known for stress relief, relaxation and releasing cramped or tense muscles. There are numerous other massage styles that range from superficial relaxation techniques to deep tissue work. Some combine physical massage with energy massage and even spiritual aspects. Massage influences healing in the body and mind, relieves stress, and relaxes soft tissue. It's used for muscle rehabilitation, pain relief and injury prevention.

Massage involves the manipulation of soft tissue in the body. This tissue comprises muscle fibers, fascia, tendons and ligaments. Massage is generally performed with strokes of the hand. A gentle, sometimes circular stroking motion is used for its soothing, calming and relaxing effects. Kneading techniques are soothing and work to relieve muscle tension, knots, congestion and spasms. There are friction movements and tapotements (rhythmic percussion) performed at varying levels of pressure and speed to bring about soft tissue relaxation or stimulation depending on how they are applied. Massage professionals use their hands as well as tools to carry out the massage. This can be strenuous work if practiced for long periods of time, or when massaging animals such as horses or dogs. It's important to know how much force to use and to be able to accurately sense areas of tension through your hands so that you can work the tissue and gauge the correct amount of force to use.

Fascia, a connective tissue, is a tough, collagenous fiber that supplies strength and support to the entire body. It comprises a web in the body that is found everywhere from head to toe, connecting and interconnecting everything without interruption. Fascia must remain flexible and elastic in order to function. Injury, repetitive stress and dehydration can cause the fascia to become hardened. This can restrict its movement, which causes pain and decreases range of motion. A healthy fascia is able to slide freely over muscles and other soft tissue. Myofascial release is a technique that loosens the fascia and allows it to soften and once again slide freely. Myofascial release techniques generally involve light pressure, maximized hand contact and rhythmic motions that produce a pushing, stretching motion.

A trigger point is a contracted knot in a muscle caused by overuse, nervous stress, poor circulation and/or buildup of lactic acid. Trigger point pain is hypersensitive and can often refer pain and other sensations to other parts of the body. This results in increased muscle tension causing bracing, clenching, compensation and decreased flexibility. Techniques to alleviate trigger points include the application of pressure and friction to break down the knot. Friction is accomplished with massage movements that consist of rhythmic pressing and small, deep circular movements. Application of pressure is done with thumb, fingertips, elbows and/or trigger point release tools.

Acupressure is an ancient healing method that originates from traditional Chinese medicine. It is used to release endorphins, relieve muscle spasms, increase circulation and to enhance overall comfort and physical and emotional health. It was developed as a preventative form of treatment and originally used to maintain the health of livestock. Acupressure uses noninvasive and extremely gentle touch techniques to move and balance life force energy. There are hundreds of acupressure points along a dozen or more major meridians in the human, horse or dog body. During an acupressure treatment, pressure is applied to specific points, or meridians, to either increase or decrease energy as needed to balance the energy in the body.

For the issues addressed above, a forceful, deep approach to massage will not be effective. Instead, a gentle touch and the ability to elongate the tissue is required. Professional massage therapists are trained in the choice and use of various massage techniques. They learn massage routines, how to recognize specific issues, which techniques to use, and how to use them. This includes the type of massage stroke, the amount of pressure to apply and for how long. They learn when they can use increased pressure, and when to move away from an affected area and return to it at a later time. To become proficient as a massage therapist requires training, practice and understanding.

Many nonprofessionals would like to have the ability to massage their horses, dogs, friends and spouses. While most people can rub a muscle and provide some comfort, it is difficult for a nonprofessional to deal with the issues described above. For example, to effectively release fascia, specific strokes and pressures are required. If a trigger point is encountered, they may not know where and how to apply pressure for an effective treatment. Untrained people simply do not usually have the knowledge and skills required for effectiveness and safety.

An issue for both professionals and nonprofessionals is fatigue. Using one's hands for massage takes strength. While giving an effective massage, the hands, arms, shoulders, etc. tire and become fatigued. This is especially true when massaging a horse where not only can the individual muscles be extremely large, but when working on an animal of a thousand pounds plus, there is a great deal of tissue to massage. Even professionals who have developed excellent stamina will experience fatigue when massaging multiple horses.

SUMMARY

There are some tools available to aid in massage. Massage devices are found in the patent art and in the marketplace. The most prevalent are elongated devices with a central shaft and a handle on each end. One or more rollers are located on the shaft between the handles in a manner that allows them to roll on the shaft. The user grips each handle and rolls the roller along the tissue being massaged with a back and forth motion. Most rollers comprise a rigid or semi rigid shaft and hard rollers. Even so-called foam rollers use a high density foam that is essentially solid. Others use hard plastic or even wooden rollers. These devices can provide a deep tissue massage, but it is difficult to use them in a manner that provides a gentle, soothing massage. These are particularly ill suited for massaging a horse, which despite its size is extremely sensitive. A horse has the ability to feel a fly land anywhere on its body, then twitch that particular muscle to shake it off. With that level of sensitivity, a hard roller provides an uncomfortable massage. Additionally, these devices are not efficient tools for myofascial release, as they cannot mimic the pressing, stretching motion needed to effectively release the fascia.

There are roller devices on the market that comprise multiple axles and rows of rollers. These devices also have their deficiencies. Most have hard rollers and cannot provide a soft touch and comfortable massage. Generally, the spacing of the axles in the fore and aft direction is too long to allow the rollers to provide the stretch needed for efficient myofascial release. Often, the rollers are spaced apart on the axles, so they do not provide a continuous contact with the tissue being massaged, which is also important for effective myofascial release.

Trigger point tools are available. For example, conventional trigger point release tools comprise rigid spherical or rounded surfaces. These surfaces are generally small in diameter, often in the range of ⅞ inch to 1¼ inches. While these are effective, the small diameter tool pressing into a tender trigger point can be painful. This can be problematic when working on an animal. It is not possible to communicate to the animal that the pain we are causing them will, in fact, make them feel better. They can become defensive, which can cause them to react in a manner that is dangerous, such as biting, kicking, etc.

In view of the above, it can be seen that there is a need in the art for a massage device that aids in reducing the user's fatigue, helps nonprofessionals perform safe and effective massage and addresses the shortcomings of conventional devices. Disclosed herein is a massage device that provides a gentle, soothing massage and manipulates the tissue to effectively release the fascia. For the purposes of this disclosure, the term tissue will refer to any or all of muscle fibers, fascia, tendons and ligaments.

The massage device of the current innovation comprises a first roller set and a second roller set in a fore and aft, or duplex arrangement. The spacing between the first and second roller sets allows the first roller set to make a first contact with the tissue being massaged and the second roller set to make a second contact with the same tissue prior to the tissue returning to its natural state, thus providing an extended stretch of the tissue. The natural state of the tissue is the condition of the tissue at rest, i.e. without any influence from the massage device or other external forces. The rollers of each roller set are substantially continuous across the roller set in order to make a consistent contact with the tissue. The rollers are constructed of a soft, resilient material that provides a gentle contact with the tissue.

Also disclosed is an ergonomic handle that allows the user to hold the massage device with a very light grip and to use natural hand and arm motions while massaging. This aids in alleviating fatigue during use. The handle also permits multiple grip methods, allowing the user to use one or both hands to hold the massage device, and to use it in any orientation. The disclosed handle is ambidextrous, so that it can be used with left or right hand. It is also bidirectional, so that the massage device can be used with a side to side or up and down arm movement. Additionally, this is a dual purpose handle that can be utilized as a trigger point release tool. The disclosed trigger point release tool distributes pressure over a larger area and provides a gentler and therefore less painful treatment relative to conventional devices.

The unique roller arrangement provides a relatively square contact configuration that is similar in size to a human hand. This allows the user to perform massage strokes and patterns that mimic a professional massage therapist's manipulation of tissue. The dissipation of pressure through the relatively square contact pattern helps both the professional and nonprofessional to control the pressure that is applied to the tissue and makes it difficult to overstress the tissue.

The massage device is particularly effective in providing myofascial release. The first roller compresses and stretches the tissue. Before the tissue can return to its natural state, the second roller provides a further compression and stretch. This sets up a wave pattern of compression and extension that relaxes and softens the fascia, releasing it and allowing it to move freely, thus alleviating pain and increasing range of motion. With this massage device, the compression, stretch and relaxation of tissue occurs in two stages. Each stage (i.e. each roller set) supplies only half of the total force applied to the tissue. This provides a gentler and more soothing feel during use than when trying to provide the same amount of compression and release with a single roller or hand.

The disclosed massage device can also provide valuable feedback about the condition of the tissue being massaged. Due to the soft and light contact, when a trigger point is encountered, the user can feel it through the handle. The trigger point can now be massaged using a rhythmic rolling method, or the massage device can be inverted and the handle used as a trigger point tool to alleviate the issue.

Acupressure uses noninvasive and extremely gentle touch techniques to move and balance life force energy. The gentleness and control provided by the massage device of the current innovation make it a valuable tool for applying acupressure techniques. This is particularly valuable to those that are not schooled in acupressure. With a casual understanding of some basic meridians, the massage device can be gently rolled along these meridians and will provide a gentle pressure to the acupressure points along the way, aiding in healing and providing a feeling of wellbeing.

BRIEF DESCRIPTION OF THE DRAWINGS

The foregoing and other objects, features and advantages will be apparent from the following description of particular arrangements of the innovation, as illustrated in the accompanying drawings. The drawings are not necessarily to scale, emphasis instead being placed upon illustrating the principles of various arrangements of the innovation.

DETAILED DESCRIPTION

Figure 6:
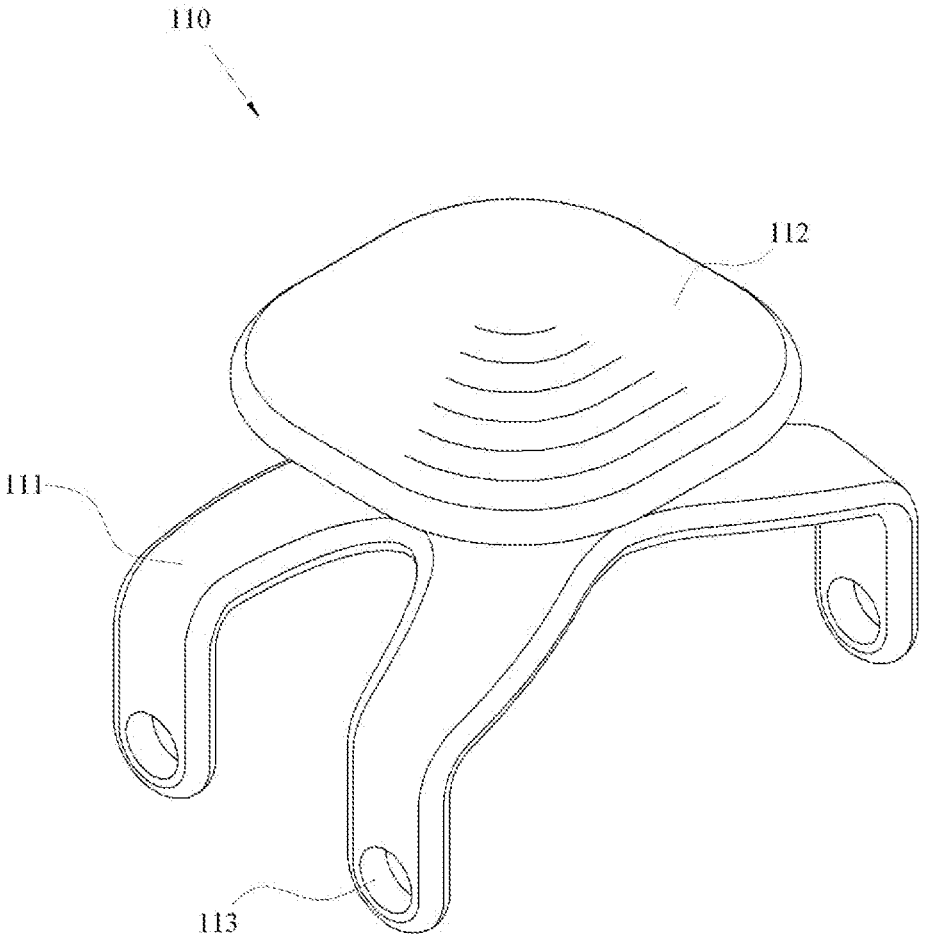
FIG. 6 illustrates an isometric view of an arrangement of a roller body.

FIGS. 1 through 5 illustrate an isometric view, a side view, a front view, a top view and a bottom view, respectively, of one arrangement of the massage device 100 of the current innovation. Visible in the Figures are the roller body 110 and two roller sets 120. FIG. 6 illustrates an isometric view of the roller body 110 with the roller sets removed. The roller body comprises a base section 111 that supports the roller sets 120, a grasping section 112 that allows the user to hold and use the massage device 100 and an elongated standoff 175 that connects the grasping section 112 to the base section 111. Taken together, the grasping section 112 and the standoff 175 comprise a handle. The base section 111 contains four holes 113 that secure the roller sets 120 into the roller body 110. The roller body can be made from any suitable material, including but not limited to ABS plastic, Nylon, ABS/polycarbonate blend, composite materials, etc. In some arrangements, the grasping section 112 can be rubberized, i.e. coated with a soft, resilient coating that provides comfort and additional grip for the user. The roller body 110 is shown as a one piece construction, however the base section 111, grasping section 112 and standoff 175 may be manufactured as any combination of separate pieces and joined together using fasteners, adhesives, welding, etc.

Figure 7:
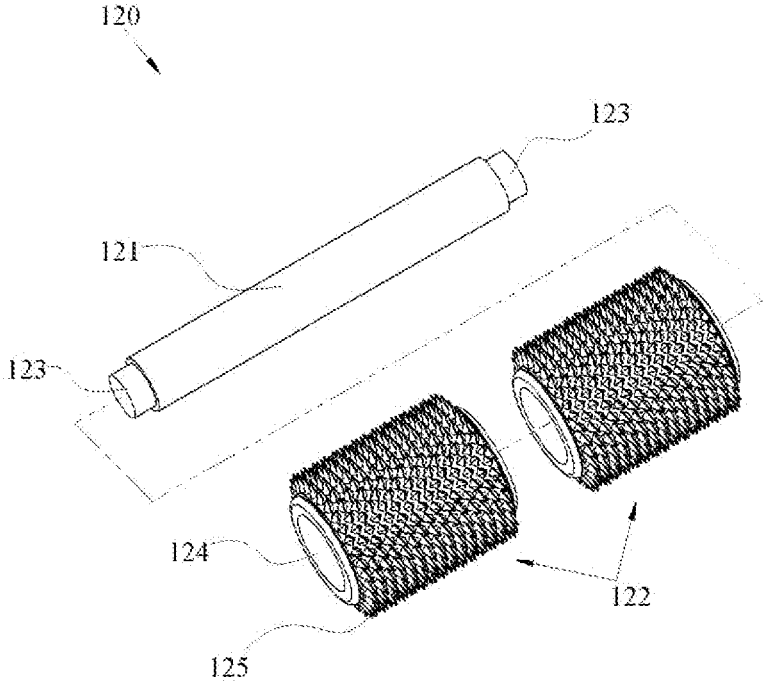
FIG. 7 illustrates an exploded view of an arrangement of a roller set.

FIG. 7 illustrates an exploded view of one arrangement of a roller set 120 that can be utilized in the current innovation. In this arrangement, the roller set comprises a roller shaft 121 that functions as an axle on which the rollers 122 can roll. In this arrangement, the roller shaft 121 has sections at each end 123 that are made to a smaller diameter than the central portion. These smaller diameter sections 123 are sized to fit within the holes 113 in the roller body 110, securing the roller set 120 within the roller body 110. The rollers 122 in this arrangement comprise a rigid inner section 124 and a soft, resilient outer section 125. The inner section 124 acts as a bearing surface as the rollers 122 roll on the roller shaft 121. Materials for the roller shaft 121 and inner section 124 of the roller can be chosen for their friction coefficient and durability for use as a bearing surface. Materials such as Nylon and acetal may be used because of their performance capability and relatively low cost, but other materials could be used, such as other polymers, coated metals, composites etc.

The outer surface 125 of the roller can be a soft, resilient material, such as an elastomeric material. This can be, for example, a natural rubber material, or a plastic or thermoplastic elastomer. The massage device of the current innovation is intended to provide a gentle, soothing massage, so the hardness of this material can be chosen to provide the desired feel. The hardness may be within the range of 20 to 70 durometer Shore A, and further within the range of 35 to 45 durometer Shore A. The rollers 122 are shown with protrusions, or nubs, around the roller's perimeter. These provide a soft, compressible contact surface. They aid in providing a gentle, soothing massage. Additionally, when massaging an animal that has a coat of hair or fur, such as a horse or a dog, these nubs penetrate the coat and help to give the animal a comfortable massage without the need to increase massage pressure to get through the coat. A resilient roller with a smooth surface or with differing patterns of raised or lowered portions is also within the scope of this innovation.

Figure 8:
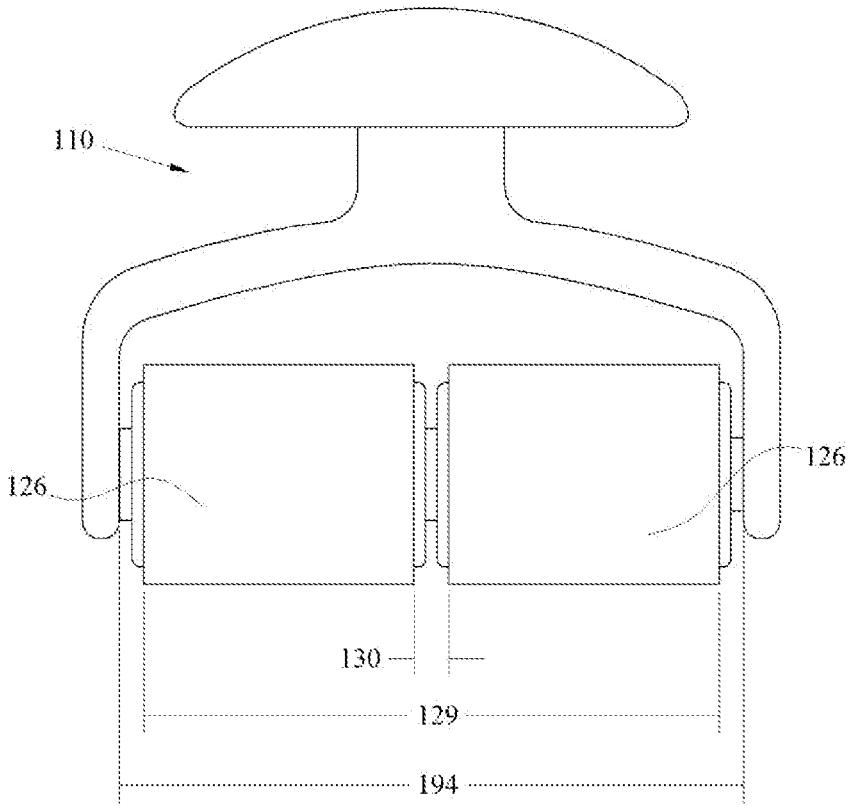
FIG. 8 illustrates a front view of an arrangement of a massage device.
Figure 9:
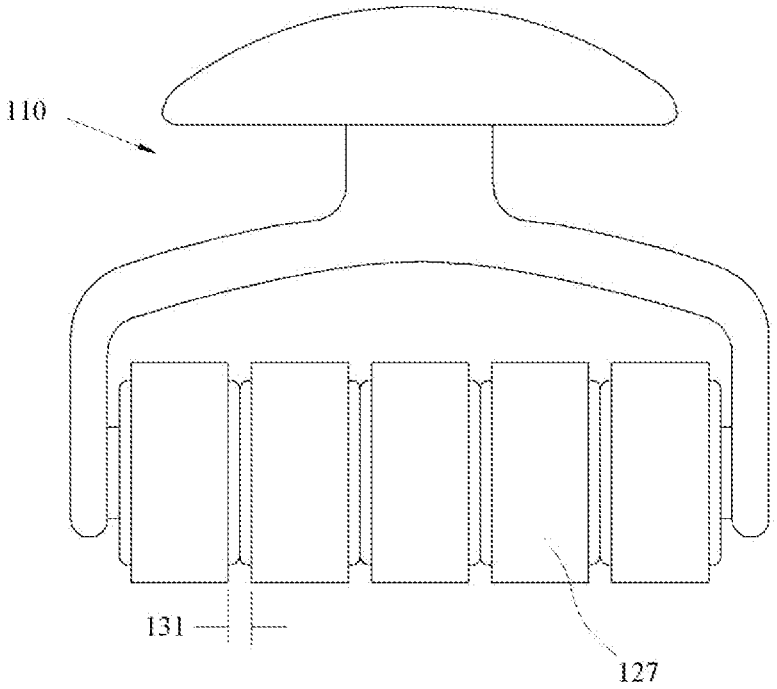
FIG. 9 illustrates a front view of an arrangement of a massage device.
Figure 10:
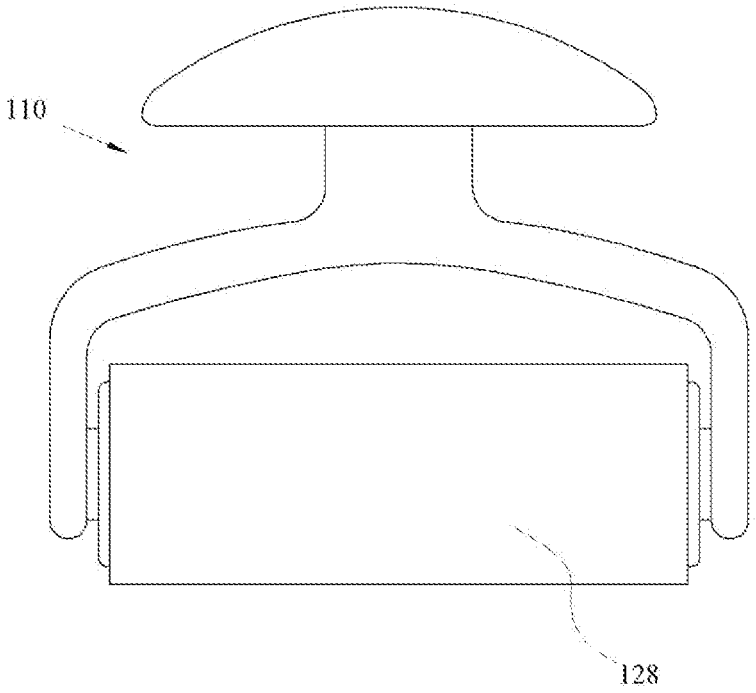
FIG. 10 illustrates a front view of an arrangement of a massage device.

In this arrangement, the roller set 120 is shown using two rollers 122 on each roller set 120. Other arrangements can use a single roller, or more than two rollers. It is important, however that the rollers create a substantially continuous surface along a longitudinal axis of the roller set. This means that gaps along the roller surface should be minimized in order to make a consistent contact surface. FIG. 8 illustrates a front view of an arrangement of a massage device that utilizes two rollers 126. FIG. 9 illustrates a front view of an arrangement of a massage device that utilizes five rollers 127. FIG. 10 illustrates a front view of an arrangement of a massage device that utilizes one roller 128. Rollers with smooth surfaces are illustrated for clarity. These Figures illustrate a substantially continuous surface.

Referring to FIG. 8, the width of the roller contact surface 129 of a two roller arrangement may have a gap 130 between the rollers 126 as they roll. This gap should be kept to a minimum to ensure a consistent contact of the rollers to the tissue being massaged. In one arrangement of a two roller device, the rollers 126 are each 2 inches wide, and the width 194 inside the roller body 110 is 4¼ inches, allowing some side to side movement of the rollers. Since the rollers 126 are free to move longitudinally on the roller shaft 121 the gap can be between the rollers 126, between the ends of the rollers 126 and the inside wall of the roller body 110, or divided in any fashion between these spaces. This means that the maximum gap 130 is ¼ inch between the rollers, and in use, the average gap will be smaller since this space is taken up not only between the rollers 128, but also between the rollers 128 and roller body 110 on each end of the roller set 120. This gap is small enough to be considered substantially continuous within the scope of this disclosure. With the 5 roller device of FIG. 9, the average gap 131 between rollers is much smaller, and is also considered substantially continuous. The single roller device of FIG. 10 inherently has no gaps.

Note that the protrusions, or nubs, on the outer surface 125 of the rollers 122 as previously described are soft and pliable and closely spaced. Features such as these still constitute a substantially continuous surface. The maximum allowable gap between rollers will depend upon the type of tissue and/or the size of the muscle being massaged. In one arrangement, a maximum gap that will work with the majority of tissues is approximately ⅜ inch. In another arrangement, this gap is ¼ inch or less.

The width of the roller sets 120 of the current innovation must be sufficient to efficiently massage a muscle. This width may be even more critical to effectively release the fascia. Effective massage requires the tissue to be compressed then extended across a substantial portion of the muscle. A narrow roller, for example one that is 1 inch wide, will provide a very narrow area of compression and extension. At a given massage force, the narrow roller will press deeper into the tissue than a wider one. This may become a deep tissue massage and no longer be the gentle massage that the current innovation can provide. It will also have little effect in releasing the fascia since so little of the width of the fascia is stretched. One arrangement of the current innovation produces a 4 inch wide roller contact. This is approximately the width of a human hand, which is an effective massage tool. Narrower or wider roller sets are anticipated by the current innovation, as long as they provide sufficient width to cover a substantial portion of the width of the muscle being targeted.

Figure 11:
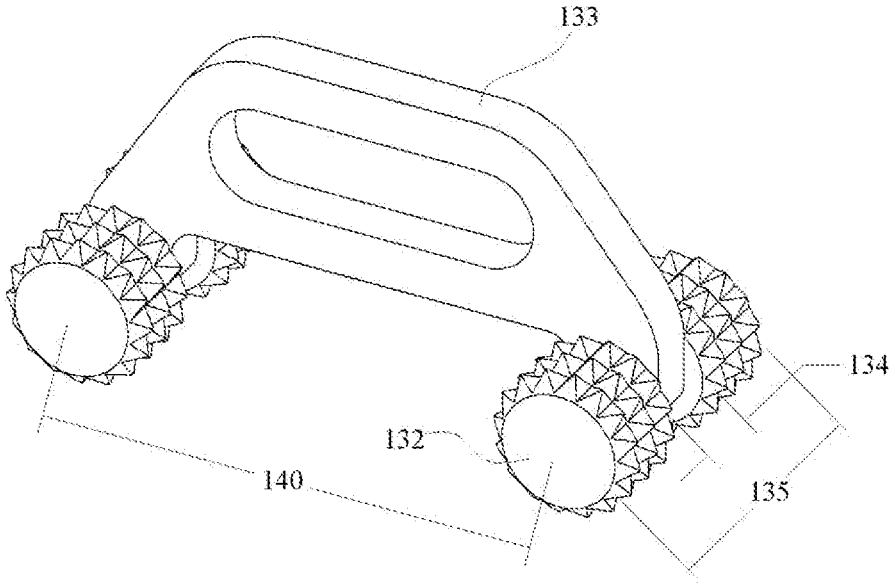
FIG. 11 (PRIOR ART)
FIG. 11 illustrates an isometric view of a prior art massage device.

FIG. 11 illustrates an isometric view of a prior art massage device. The pictured device is modelled on the Hand Massage Roller in Wood, manufactured By Miglani of India. In it can be seen the rollers 132 and body 133. The gap 134 between the rollers 132 is ½ inch or more, and the total width 135 is approximately 2.5 inches, meaning that the rollers 132 are approximately 1 inch wide each. The total roller contact is 2 inches, so the ½" gap represents ¼ of the total contact surface. This is a large enough gap to allow the tissue being massaged to enter the gap between the rollers. In the scope of this disclosure, this is not considered substantially continuous.

Figure 12:
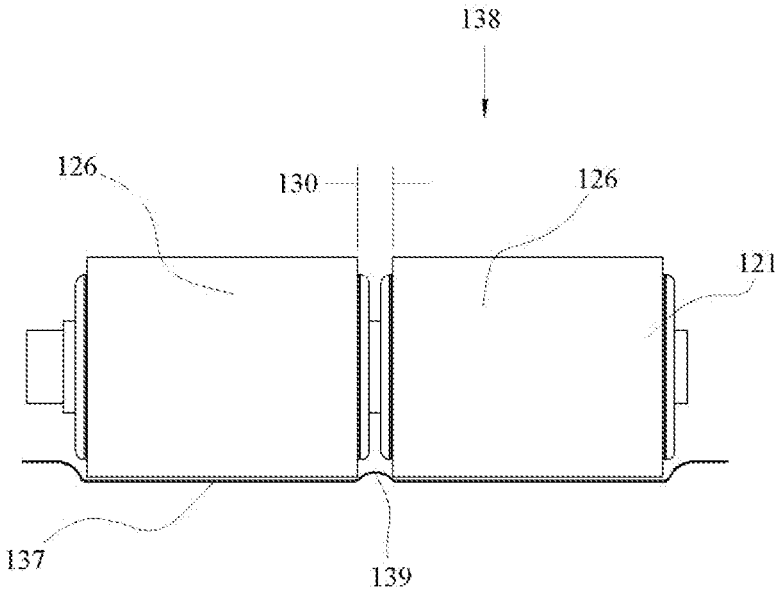
FIG. 12 illustrates a front view of two rollers in contact with tissue.

To further illustrate this concept, FIG. 12 illustrates a front view of two rollers 126 and roller shaft 121, as seen in FIG. 8. The gap 130 between the rollers is ¼ inch as described above. The roller body has been removed for clarity. The rollers are in contact with the tissue 137 being massaged. During a massage, a downward force 138 from the rollers applies pressure and compresses the tissue. Wherever the roller does not make contact, the flexible tissue will enter the gap. The small gap 130 between the rollers 126 minimizes this effect as very little tissue 137 enters the gap 139.

Figure 13:
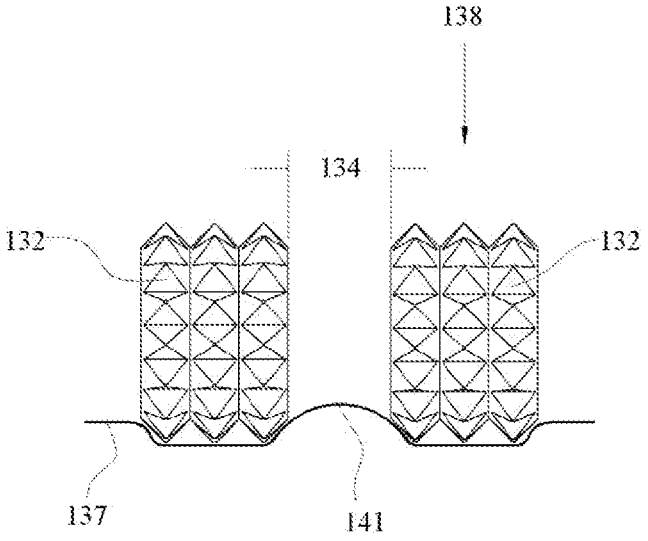
FIG. 13 (PRIOR ART)
FIG. 13 illustrates a front view of two prior art rollers in contact with tissue.

FIG. 13 illustrates the rollers 132 of the prior art massage device of FIG. 11 in contact with the tissue 137 being massaged. The roller body has been removed for clarity. The wider gap 134 allows the tissue to enter between the rollers 132 and distort 141 when the force 138 presses the rollers 132 into the tissue 137 during a massage. This tissue distortion causes an inconsistent contact resulting is a less soothing massage and is particularly inefficient at myofascial release.

Figure 4:
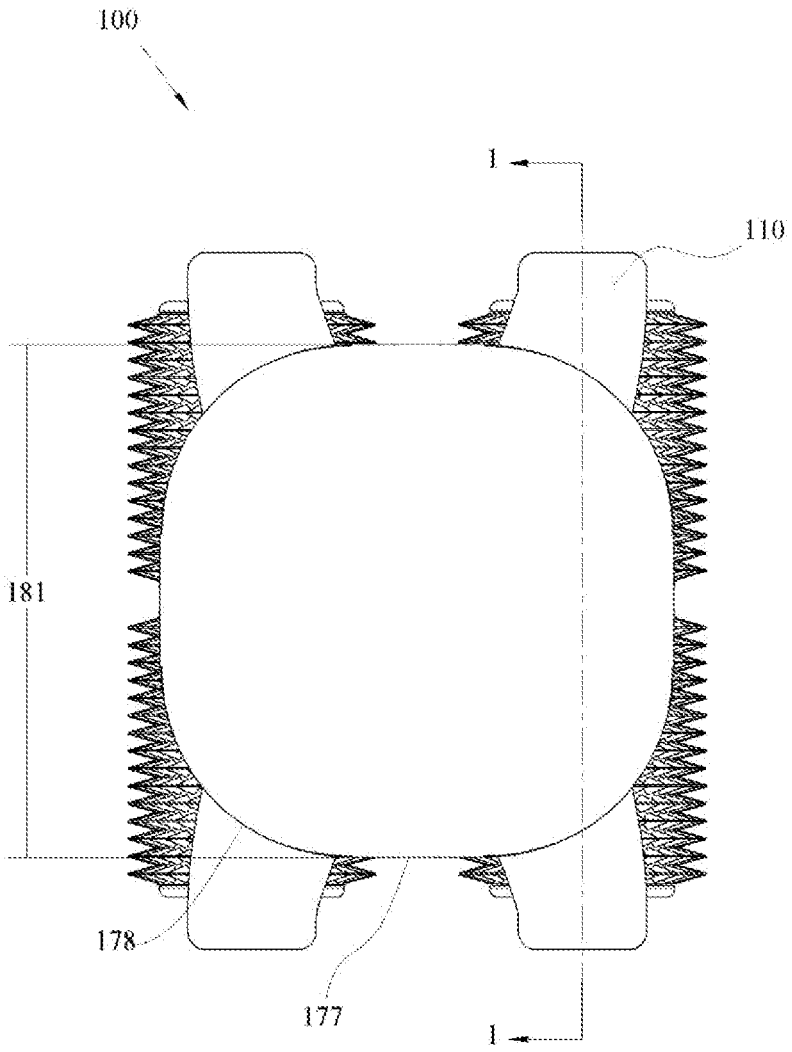
FIG. 4 illustrates a top view of an arrangement of a massage device.
Figure 5:
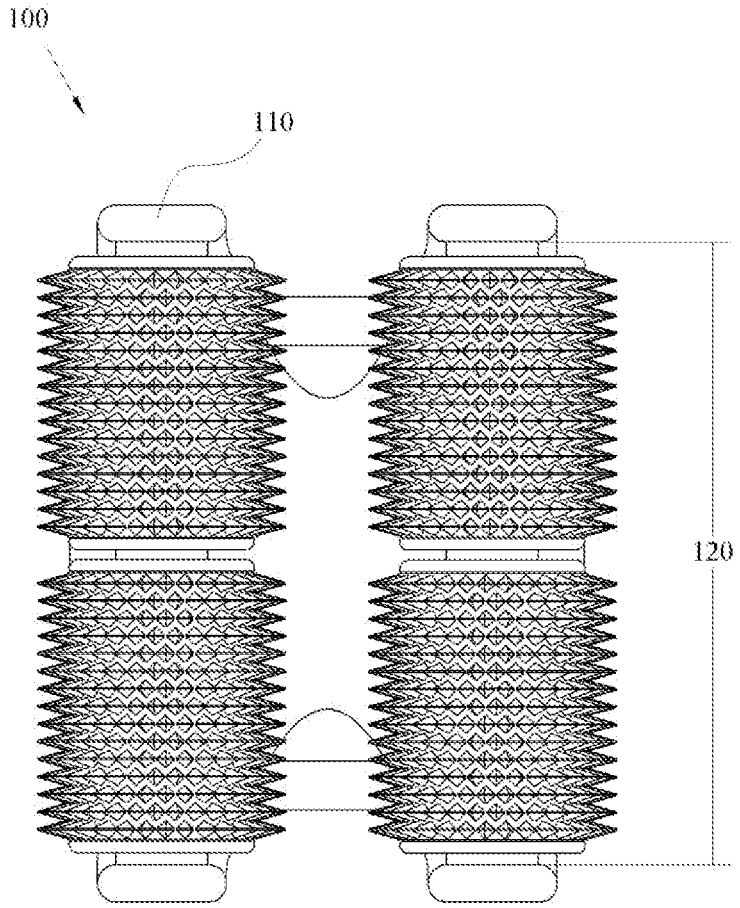
FIG. 5 illustrates a bottom view of an arrangement of a massage device.
Figure 14:
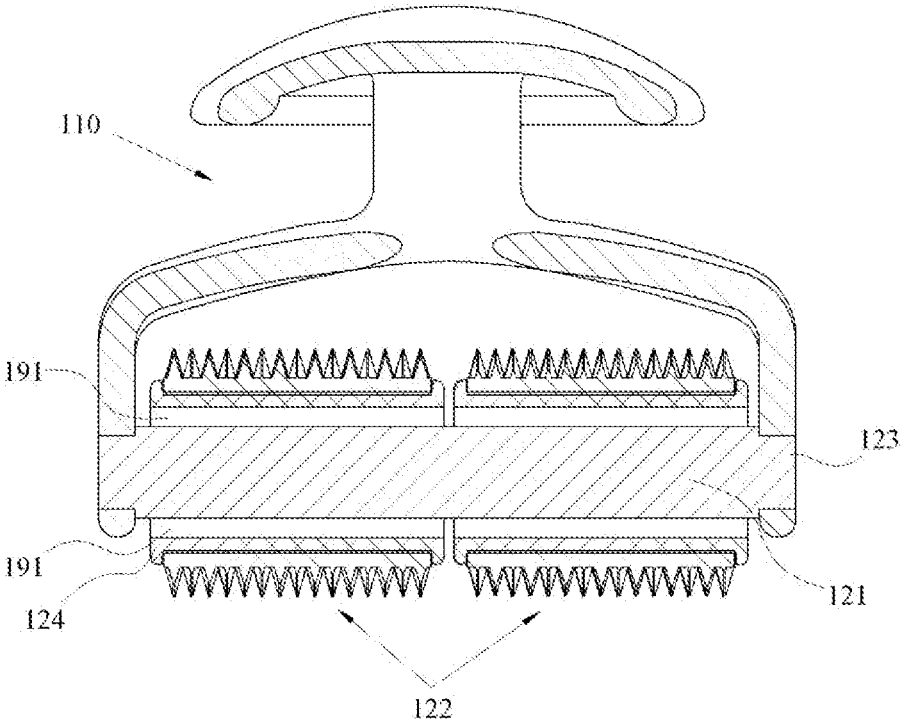
FIG. 14 illustrates a cross sectional front view of an arrangement of a massage device.

FIG. 14 illustrates a cross sectional view taken through Section 1-1 of FIG. 4. In it can be seen the roller body 110 with the roller shaft 121 in position with its smaller diameter sections 123 inserted into the holes 113 (FIG. 6) in the roller body. The rollers 122 are in place on the roller shaft 121. The roller/shaft interface creates a bearing system. In this arrangement, the outer diameter of the bearing section of the roller shaft 121 is substantially smaller than the inner diameter of the inner section 124 of the roller 122. This creates a gap 191 between the inner diameter of the roller 122 and the outer diameter of the roller shaft 121. In the Figure, the gap is shown evenly spaced above and below the roller shaft 121. In use, the downward force will press the rollers 122 against the roller shaft 121, leaving the entire gap above the roller shaft 121. This design allows the rollers 122 to move about freely on the shaft 121 which aids in allowing the rollers to follow the contours of the tissue being massaged.

Further, the massage device 100 is often used to massage horses and other animals. These animals have hair or fur that may be shed during a massage. When used in a barn environment, the massage device 100 is exposed to dirt, dust and other contaminants. A tight fitting bearing system may be susceptible to becoming clogged with hair or other contaminants. The loose fitting system shown here allows the contaminants to fall out of the gap 191 between the rollers 122 and roller shaft 121. If this area does get dirty, the gap 191 allows for easy cleaning as water can be used to flush the contaminants out of the space. In one arrangement, the outer diameter of the roller shaft 121 is approximately 0.6 inches, and the inner diameter of the inner section 124 of the roller 122 is approximately 0.9 inches. In another arrangement, the outer diameter of the roller shaft 121 is approximately 0.75 inches.

In the arrangement shown, assembly of the roller set 120 to the roller body 110 is accomplished as follows. The rollers 122 are placed onto the roller shaft 121. One end 123 of the roller shaft is placed into one hole 113 in the roller body 110. The opposite end of the roller body 110 is flexed outward. Now the opposite end 123 of the roller shaft 121 is placed into the hole 113, and the roller body 110 returns to its original shape, thus capturing and containing the roller shaft 121. This description exemplifies one arrangement of the current innovation and is not meant to be limiting. Other designs, the use of ball, roller or other bearings, different assembly techniques, alternate materials and dimensional differences are within the scope of this disclosure.

Figure 15:
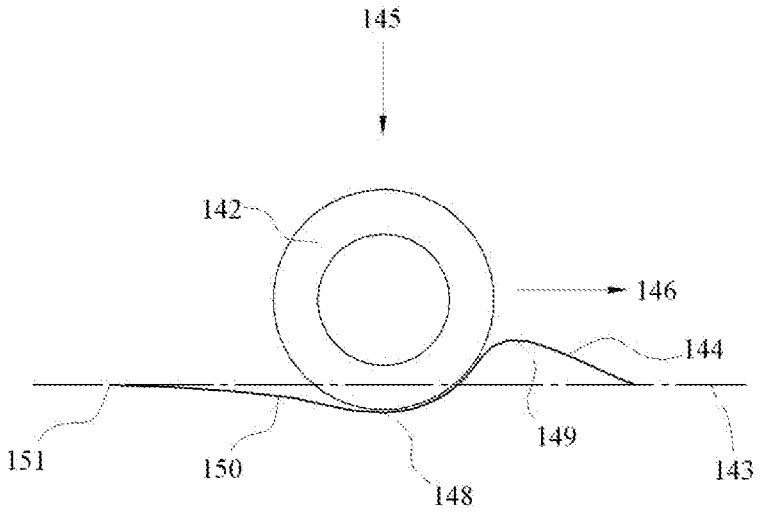
FIG. 15 illustrates a side view of a single roller in contact with tissue.

FIG. 15 illustrates a side view of a single roller 142 that can be used with the massage device 100 of the current innovation. For clarity, no other components of the massage device 100 are shown and the roller 142 is shown with a smooth surface. This Figure illustrates the interaction between the roller 142 and the tissue being massaged as the roller is rolled across the tissue. The dash-dot line 143 represents the surface of the tissue when the muscles are in their natural state, neither under compression nor extension. This is a state in which no external forces, for example a massage roller, other massaging action, etc., are acting upon the tissue and it is at rest. The solid line 144 represents the surface of the tissue during the massaging action. In use, a downward force 145 is exerted onto the roller to press it into the tissue. The downward force used during massage can vary depending on factors that include the size and type of muscle being massaged, the desired penetration of the massaging action and the diameter and hardness of the roller. For a 1.5 inch diameter roller set that is 4 inches long with a hardness of 40 durometer Shore A, a general range is approximately 1 to 8 pounds for a gentle massage. In this example the massage roller 142 is moved in a direction 146 that produces a clockwise rotation of the roller 142.

As the roller 142 contacts the tissue 144 and is rolled with a downward force, it displaces the tissue downward and forward at the point of contact 148. This action compresses a front tissue portion 149 relative to the roller. A compression area 149 is developed in front of the roller 142 as the tissue is displaced forward and upward. In the Figure, the actual displacement may be exaggerated for clarity. Extension, or stretching of the tissue is taking place behind the roller 142. This action extends a rear tissue portion 150 relative to the roller 142. At this point, the tissue begins to return to its natural state. At a point 151 that is a distance behind the roller 142, the tissue has returned to its natural state, and is no longer under compression or extension. It is this compression, stretching and relaxing of the fascia, muscles and other soft tissue that increases blood flow, releases trigger points, soothes muscles and releases the fascia. Using a single roller as shown, the only way to increase the amount of massage and release action is to press the roller into the tissue with more force. This becomes a deep tissue massage and is common in massage practice. A deep tissue massage, however, is less efficient at releasing the fascia, and can be painful, particularly when performed on sore muscles or on trigger points. This can be particularly troublesome when massaging an animal, since they can become defensive when feeling pain. The result can be an uncomfortable experience for the animal, along with the dangers of bites, kicks, etc.

Figure 16:
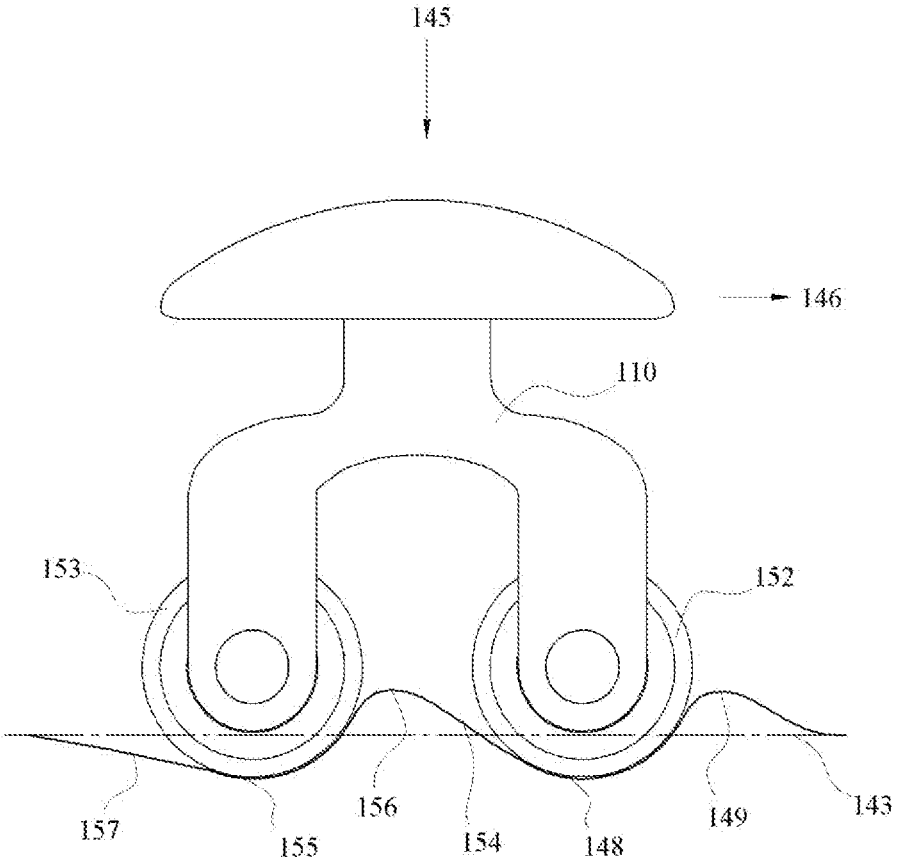
FIG. 16 illustrates a side view of an arrangement of the massage device in contact with tissue.

The duplex massage device 100 of the current innovation can increase the amount of compression, stretching, relaxing of the fascia and release of trigger points without becoming a deep tissue massage, and without increasing the total force on the tissue. This is accomplished by spacing a second roller set at a distance behind the first roller set that allows it to contact the tissue behind the first roller set prior to the tissue returning to its natural state, FIG. 16 illustrates a side view of an arrangement of a massage device 100 of the current innovation. In it can be seen a first roller set 152 and a second roller set 153, along with the roller body 110. As with the FIG. 15 example, the dash-dot line 143 represents the surface of the tissue in its natural state. A downward force 145 is exerted to press the rollers into the tissue, and the massage device 100 is moved in a direction 146 that produces a clockwise rotation of the rollers. The first roller set 152 displaces the tissue downward where it makes contact 148. This action compresses a front tissue portion 149 relative to the first roller set 152. A compression area 149 is developed in front of the first roller set 152 as the tissue is displaced forward and upward. Extension, or stretching of the tissue is taking place behind the first roller set 152. This action extends a rear tissue portion 154 relative to the first roller set 152. The second roller set 153 is spaced behind the first roller set 152 so that it comes into contact with the tissue prior to the tissue returning to its natural state 143. This creates a displacement 155 of the tissue below the second roller set 153 compressing a front tissue portion 156 relative to the second roller set 153. Behind the second roller set 153 a rear tissue portion 157 is extended relative to the second roller set 153. After this point, the tissue returns to its natural state.

Figure 1:
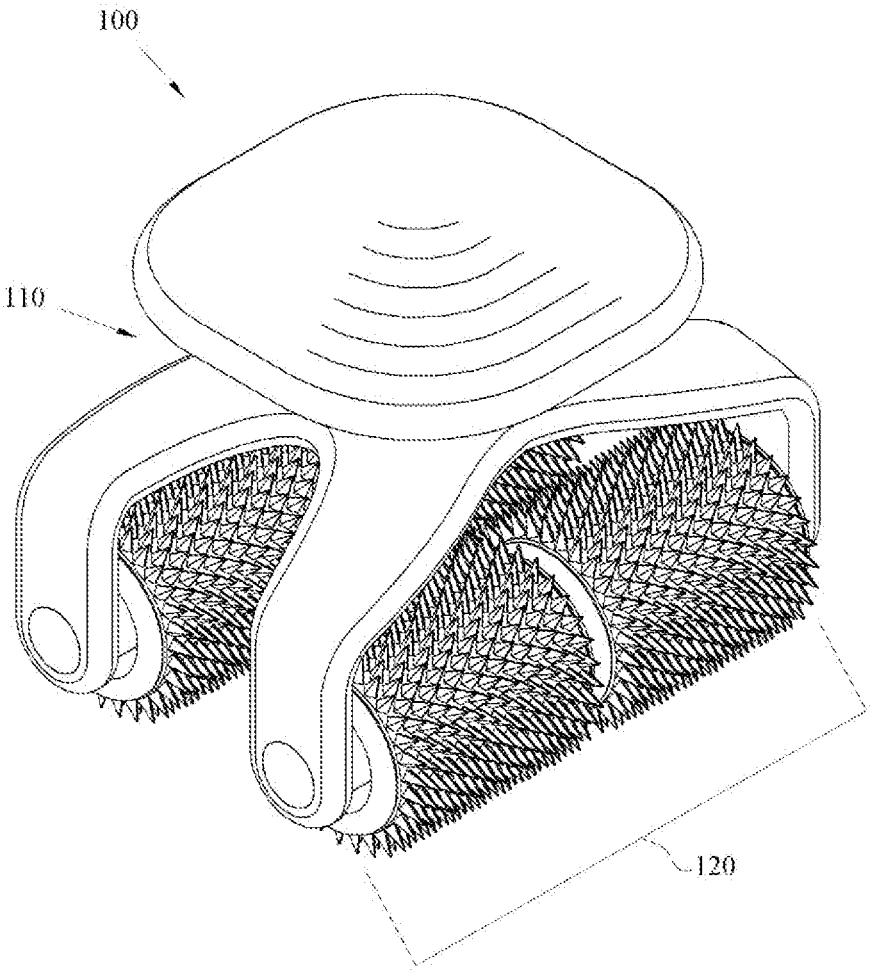
FIG. 1 illustrates an isometric view of an arrangement of a massage device.
Figure 2:
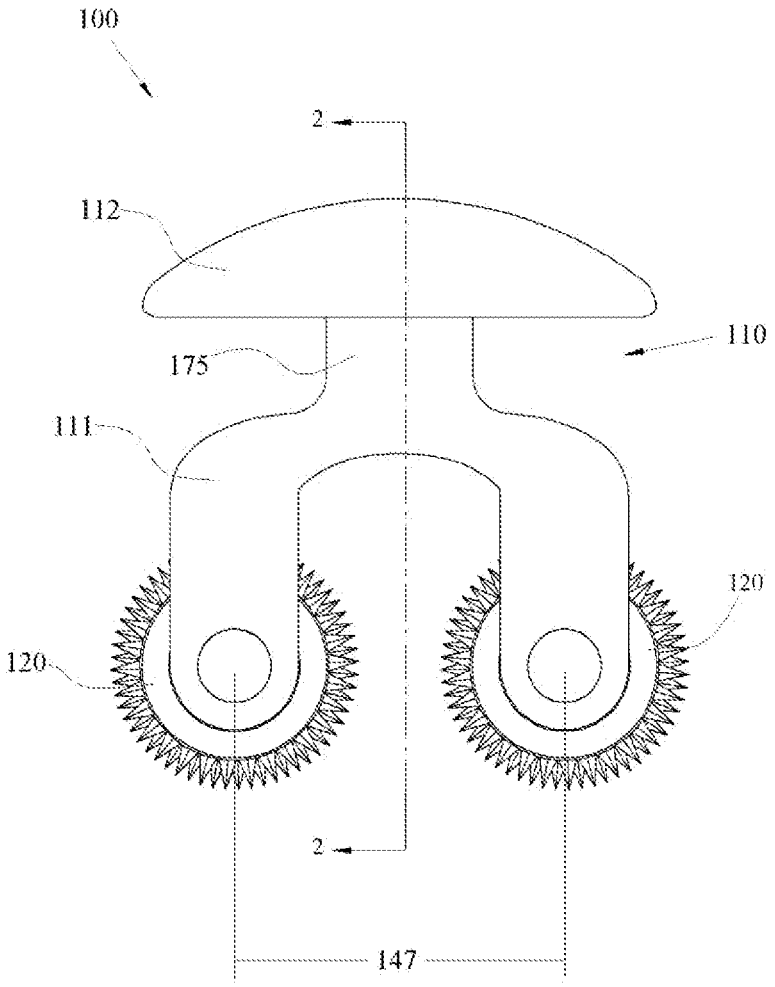
FIG. 2 illustrates a side view of an arrangement of a massage device.
Figure 3:
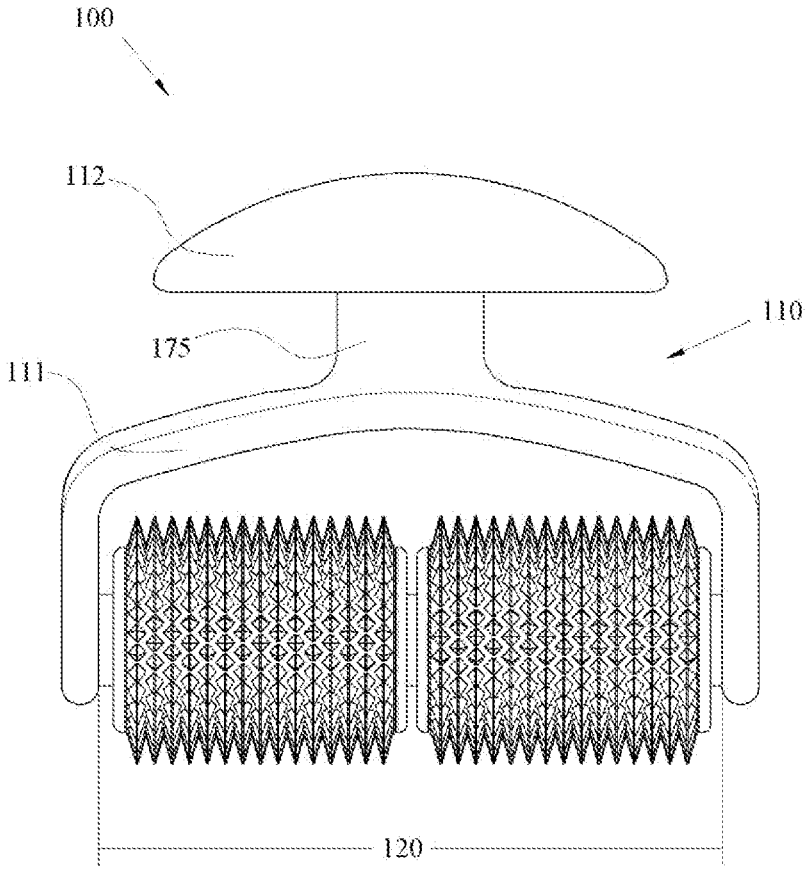
FIG. 3 illustrates a front view of an arrangement of a massage device.

In one arrangement of the current innovation, the rollers have a diameter of 1.5 inches and are spaced 2.25 inches apart between their centers 147 (FIG. 2). The maximum spacing distance for the rollers that will achieve the desired effect will depend on variables that include the size and density of the tissue being massaged, the diameter of the rollers, the force with which the rollers are pressed into the tissue, the speed at which the rollers are rolled, etc. A general range for roller spacing for the massage device of the current innovation is a minimum of approximately 1.1 roller diameters and a maximum of approximately 4 roller diameters. One arrangement has a range of approximately 1.5 to 2 roller diameters.

In use, the first roller set 152 performs a first action of massage as described. Before the tissue has returned to its natural state, while the muscles and fascia behind the first roller set 152 are still extended and stretched, the second roller set 153 performs a second action of massage. Since the second roller set 153 begins a massaging action on tissue that is already extended, the resultant massage, i.e. displacement, compression and extension of tissue, is compounded and therefore substantially deeper and more thorough than that created by the first roller set 152 alone. This gives an advantage to the duplex massage device over conventional single roller set massage devices. For example, if the duplex roller device is pressed with 8 pounds of force into the tissue, the resultant force on each roller is half that, or 4 pounds. To obtain the same depth of massage with a single roller set, the full 8 pounds would need to be applied to one roller set. This means that the force exerted on the tissue by each roller of the duplex massage device is half that of the single roller set device. The lower force exerted by the duplex roller provides a more soothing and less painful massage, especially on sore muscles or trigger points. Additionally, performing the massage in two stages provides two compression and extension cycles for each massage stroke, which compounds the positive effect of the massage. It also results in a lengthened time in which the tissue is compressed and extended, which aids in releasing the fascia.

Figure 17:
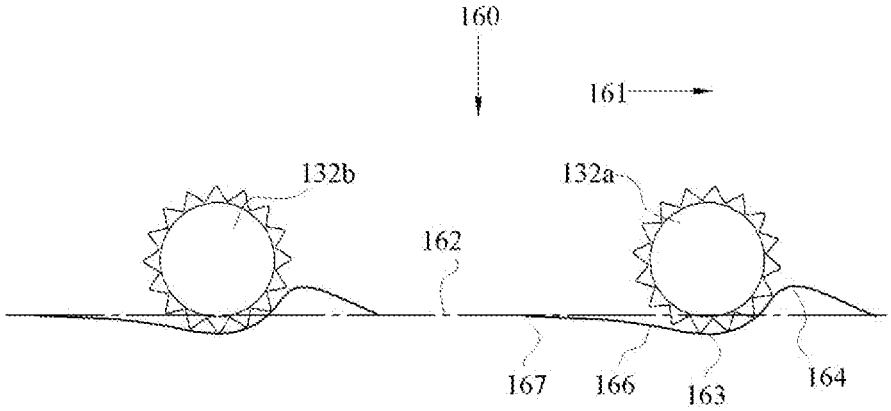
FIG. 17 (PRIOR ART)
FIG. 17 illustrates a side view of two rollers of a prior art massage device in contact with tissue.

To illustrate the distinction of the current innovation to conventional devices, FIG. 17 illustrates a side view of the rollers 132*a*, 132*b* of the prior art massage device seen in FIG. 11. The body 136 is not shown for clarity. The distance 140 between the rollers as shown is approximately 5 inches, which with the 1 inch diameter rollers 132 relates to approximately 5 diameters. The rollers 132*a*, 132*b* are pressed downward with a force 160 and are rolled in a forward direction 161, resulting in a clockwise rotation of the rollers 132*a*, 132*b*. The dash dot line 162 represents the tissue in its natural state. The first roller 132*a* presses into and displaces the tissue 163, creating the compression area 164 in front of the roller. Behind the roller the tissue 166 begins to return to its natural state, and completes its return at a point 167. As can be seen, the tissue reaches its natural state at a distance prior to contact with the second roller 132*b*. The second roller 132*b* creates a compression area in front of it and an extension area behind it. However, since it is starting with the tissue in a natural state, it is only repeating the action of the first roller 132*a*, and does not gain an extended compression or extension as with the massage device 100 of the current innovation.

Figure 18:
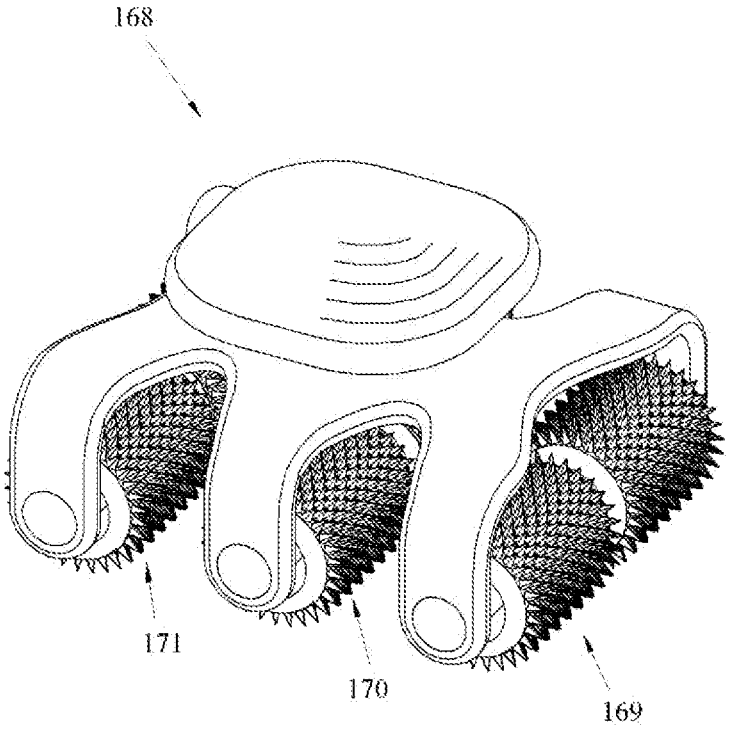
FIG. 18 illustrates an isometric view of an arrangement of a massage device with three roller sets.

FIG. 18 illustrates an isometric view of an arrangement of a massage device 168 of the current innovation that includes three roller sets 169, 170, 171. The distance between the first roller set 169 and the second roller set 170 as well as the distance between the second roller set 170 and the third roller set 171 are as previously described for the duplex massage device 100. In use, the first roller set 169 performs a first action of massage. Before the tissue has returned to its natural state, and the muscles and fascia are still extended and stretched, the second roller set 170 performs a second action of massage. Before the tissue behind the second roller set 170 has returned to its natural state, the third roller set 171 begins a third action of massage. It can be appreciated that devices containing four or more subsequent roller sets will remain within the scope of this innovation.

Figure 19:
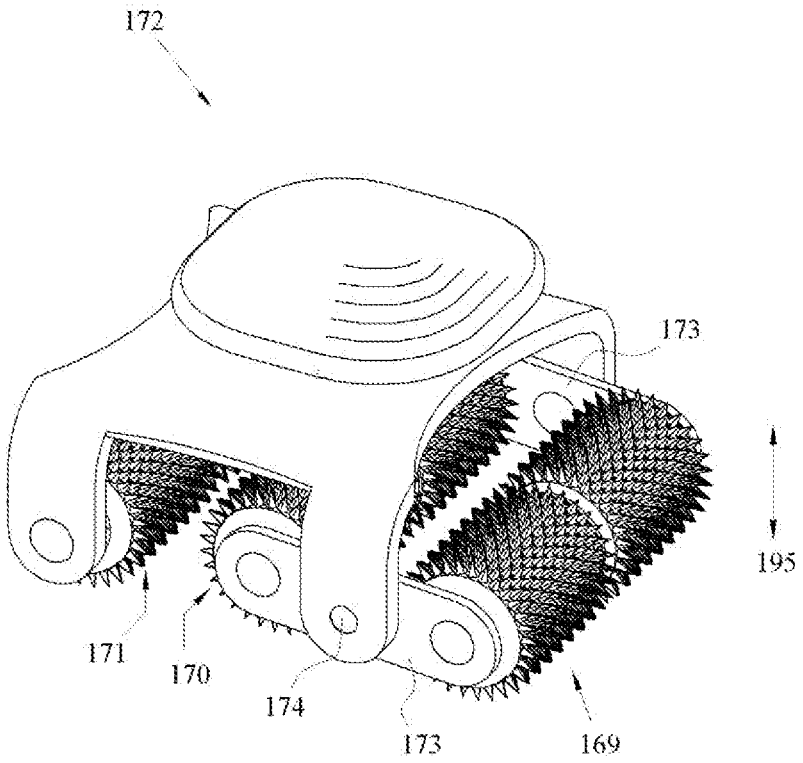
FIG. 19 illustrates an isometric view of an arrangement of a massage device with three roller sets.

FIG. 19 illustrates an alternative arrangement of the three roller set massage device 172. In this arrangement, the first 169 and second 170 roller sets are connected to two pivoting links 173 that attach to the roller body and pivot at a point 174. The pivot links 173 can rotate about the pivot point 174, allowing the rollers 169, 170 to move vertically 195 as the massage device 172 is rolled across the tissue, so that the rollers can follow the contour of the tissue. This keeps all of the rollers in consistent contact with the tissue. If a four roller set device is used, two of these pivoting systems can be used, thereby keeping all of the rollers in consistent contact with the tissue. Other methods of allowing the roller sets to move and to compensate for tissue contour, such as individual spring loaded roller sets, etc. are also anticipated by this innovation.

Figure 20:
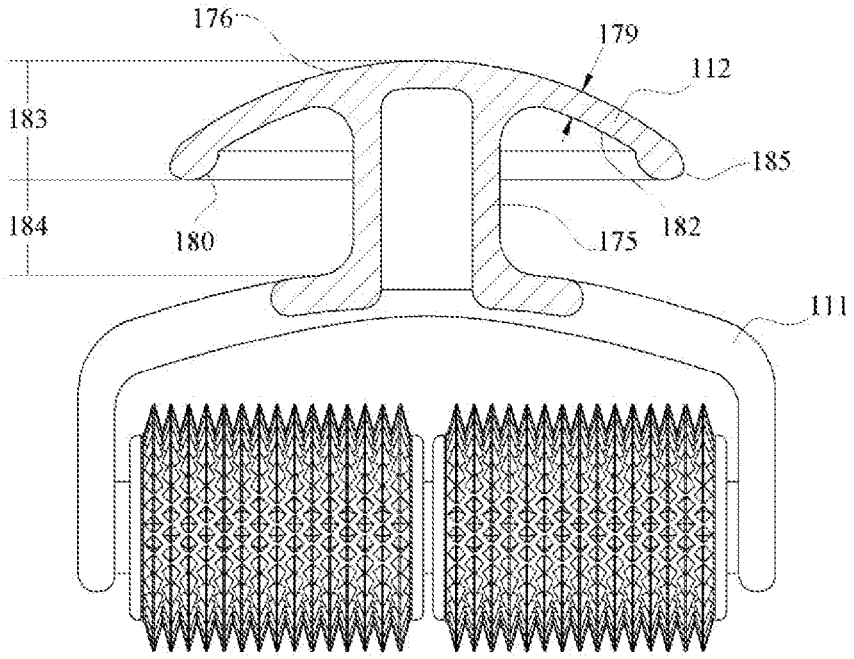
FIG. 20 illustrates a cross sectional front view of a handle of an arrangement of a massage device.

In one arrangement, the massage device of the current innovation includes an ergonomic handle that alleviates the user's hand and arm fatigue and allows for multiple grip positions. FIG. 20 illustrates a cross sectional view of the massage device 100 taken through Section 2-2 of FIG. 2. Also referring to FIG. 4, the handle comprises a grasping portion 112 and a standoff portion 175 that is coupled to a base section 111. This standoff portion 175 allows room for the user's thumbs, fingers and knuckles when the grasping portion 112 is gripped as the massage device 100 is used. The upper surface 176, or first side, of the grasping portion 112 comprises a curve. This can be a constant radius curve or a multi-radius curve such as a parabola, ellipse, compound curve, etc. In this arrangement, the perimeter 177 of the handle is a square with rounded corners 178. A round handle may be used, but the squared handle as shown may provide improved support for the user's hand as well as a longer grip surface when using certain grip methods. The lower surface 182, or second side, of the grasping portion 112 defines a wall thickness 179 that results in a hollow grasping volume below the handle. The hollow area aids the user's grip when using certain grip methods. A radius 180 or other shape may be included on the lower inside edge of the grasping portion 112. This creates a brim that helps the user hold the handle with a loose grip when using certain grip methods by keeping the fingers from sliding out from underneath the grasping portion 112.

The handle features described herein are intended to let the user hold onto the massage device 100 with a light, loose grip. As such, the light grip keeps the user's muscles, particularly those in the hand and forearm, soft and supple while using the massage device. In contrast, if a handle requires a tight grip, the hand and arm muscles contract and stiffen. These clenched muscles will tire much more quickly than a relaxed muscle. When a massaging action is performed, these tight, contracted muscles require more physical effort to move through their motions. This leads to muscle fatigue and leaves the user susceptible to injury, such as strain, repetitive motion injury, etc. The light grip afforded by the handle of the current innovation aids in keeping these muscles from tightening during the massage action, alleviating fatigue and reducing the possibility of injury. Further, the handle allows for multiple grip methods and therefore multiple hand positions, allowing the user to grip with one hand or two, in multiple combinations. The disclosed handle is ambidextrous, meaning it can be used with left or right hand, as well as bidirectional, meaning it can be used with a side to side or up and down arm movement. These features give the user a great deal of flexibility when using the massage device.

Following are exemplary handle layout and dimensions for one arrangement of the handle of the current innovation. The sizing of this handle works well across a wide range of user's hand sizes. Referring back to FIGS. 4 and 20, in this example the surface 176 on the first side of the grasping portion 112 is a simple radius of 2.75 inches. The distance between the flats 181 of the handle is 3.5 inches, and the corner radius 178 is 2.0 inches. The height 183 of the grasping portion 112 is 0.8 inches and the height of the standoff 184 between the bottom of the grasping portion 112 and the top of the base section 111 is approximately 0.6 inches. The shape around the perimeter 185 of the grasping portion 112 is a compound radius that transitions from approximately 0.2 to 0.1 to 0.2 inches. Those skilled in the art can recognize that these dimensions can be modified if the massage device is intended for a specific range of hand sizes, for example, a smaller handle for youth sized hands, etc., or for other design or aesthetic purposes. The intent is that the radius of the first side 176 fits comfortably into the palm or fingers of the hand, and supports the hand through its entire contact with the handle. The overall size of the handle allows the thumb and fingers to lightly hold the edge of the handle when lifting it to move between massage areas. The hollow volume below the handle leaves space for fingers and knuckles when gripping the handle by the rim, and the shape of the underside of the handle provides a comfortable and easy grip.

The example of massaging a horse helps to illustrate the value of multiple grip and hand positions. A medium size horse may weigh in excess of 1000 pounds and stand about five feet tall at the withers, or top of the shoulder. The horse is massaged while standing. The surfaces of the horse that may be massaged include the side of the neck, the top and sides of the back, the underneath of the barrel, the entire hind end, the chest, and front, rear, inside and outside of the four legs. To gain access to all of these surfaces, the massage device will be held and used in horizontal, vertical even upside down positions. The massaging motions can be side to side, front to back, up and down, etc., and in any orientation. Varying amounts of pressure may be desired depending on the sensitivity of particular areas, and the size and condition of the tissue being massaged. The massage device of the current innovation to allows the user to maintain a comfortable, relaxed grip as well as being able to grip in ways that allow the user to exert more or less pressure as desired.

In one arrangement, the handle can be utilized as a trigger point release tool. Trigger point release tools are common in the art and are generally separate, hand held tools. When a trigger point, such as a muscular knot, lactic acid build-up or other nodule is found, the trigger point release tool is pressed into the affected area to disrupt the nodule and release the trigger point. This is normally accomplished with multiple press and release cycles using varying pressure. The radius on the first side 176 of the handle 112 can be used in this manner. When a trigger point is found, the massage device 100 can be inverted, and the radius can be pressed into the nodule to release it. Conventional trigger point release tools typically define spherical or rounded surfaces. These surfaces are generally small in diameter, often in the range of ⅞ inch to 1¼ inches. While these tools are effective, the small diameter pressing into a tender trigger point can be painful. This can be problematic when working on an animal. It is not possible to communicate to the animal that the pain we are causing them will, in fact, make them feel better. They can become defensive and react in a manner that is dangerous, such as biting, kicking, etc. The large radius and expanded size of the handle as disclosed causes the pressure to be dissipated over a larger area of tissue. This provides a gentle, soothing release that causes relatively less pain than conventional trigger point release tools.

Figure 21:
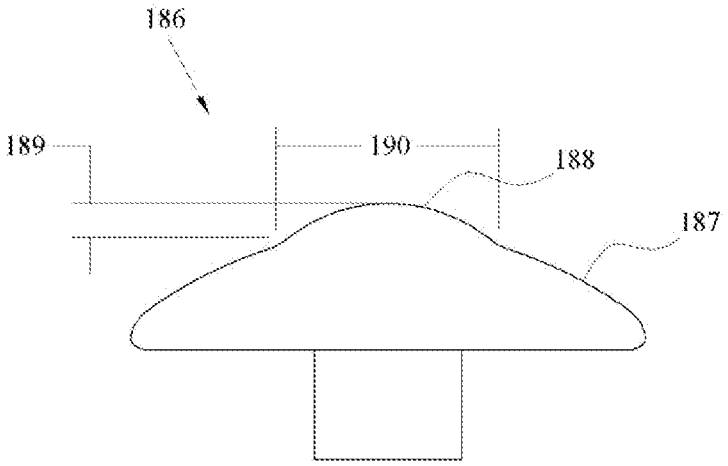
FIG. 21 illustrates a side view of an arrangement of a handle.

Variations in the shape of the handle are anticipated and within the scope of this innovation. FIG. 21 illustrates a side view of a handle 186 with an alternative shape that can be useful in releasing trigger points. In this arrangement, the major radius 187 of the first side of the grasping portion remains the same as described for the constant radius arrangement. A raised section 188 is included at the top center of the handle. In this example, the raised section 188 has a radius of 1.5 inches. Its height 189 protrudes 3/16 inch above the top of the major radius 187. This raised radius has a width 190 of approximately 2 inches and blends into the handle radius 187. When used as a trigger point release tool, the raised section 188 penetrates deeper into the trigger point than the major radius 187, while still supporting the surrounding tissue with the major radius 187. In this arrangement, the raised section 188 is not pronounced enough to press into the palm or fingers of the hand of the user, as that may cause discomfort to the user during massage use. The dimensions and specific shape disclosed here is not meant to be limiting. Multiple variations of shape and dimension are anticipated by the current innovation.

Figure 22:
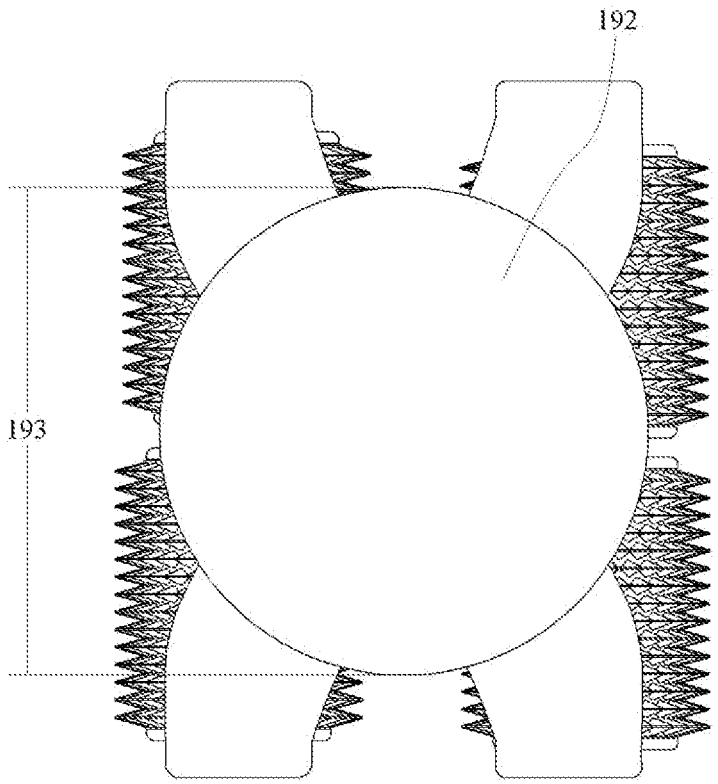
FIG. 22 illustrates a top view of an arrangement of a massage device.

FIG. 22 illustrates a top view of a massage device utilizing a handle 192 with a round perimeter. In this example, the diameter 193 of the handle is 3.3 inches. A front view of this handle may be the same as previously disclosed and illustrated in FIGS. 20 and 21, and exemplary dimensions are as previously described. Those skilled in the art can recognize that these dimensions may be modified if the massage device is intended for a specific range of hand sizes, for example, a smaller handle for youth sized hands, etc., or for other design or aesthetic purposes.

The massage device of the current innovation is versatile and can be used in multiple orientations and using one or both hands. Following are examples of some of the methods for using this device.

In a one-handed use, the user rests their hand on the handle 112 so that the radius fits comfortably in the palm of the hand. The massage device is orientated in the hand with the roller shaft parallel to the fingers. In this orientation, the massage device can be used to apply side to side massage strokes. The hand is relaxed and the wrist is in a neutral position. The hand does not need to grip the handle in order to apply the massage strokes. This light grip allows the hand and forearm muscles to remain loose while the massage device is being used. This reduces the stress that causes arm fatigue and reduces the chance that the user will develop an injury such as a repetitive motion injury. The massage device can be rotated by 90 degrees in the hand so that the roller shaft is perpendicular to the fingers. This orientation is used to apply an up and down or fore and aft rather than side to side massage stroke. The hand may also be placed so that the radius is centered under the fingers rather than palm of the hand. When using the massage device as described, the action mimics wiping the hand or fingers across the surface of the tissue, and so is very comfortable and natural. To lift the massage device from the surface being massaged, the thumb and little finger lightly grip the underside of the handle, and the massage device is lifted with little effort.

With another one-handed grip, the fingers grip around an edge of the handle with the heel of the hand pressing on the top of the grip. This grip is useful when reaching to massage hard to reach locations, such as the inside of a horse's leg. Both hands may be used to grip the handle in this manner, one hand on each of an opposing handle edge 177, and the heels of both hands can be used to press on the handle with additional force. Alternatively, the edge of the handle can be gripped with one hand while the other hand presses with palm or fingers on the top of the handle. This grip provides for a high degree of control and is useful for applying extra pressure to the tissue being massaged.

These and other methods of holding and hand positions are possible. This is not meant to be an exhaustive list of examples, as there are a multitude of ways in which this handle can be gripped. In use, hand positions will be chosen based on the type of massage stroke being performed, the location of the tissue being massaged and the personal preference of the person performing the massage. Because of the symmetrical nature of the grip, all techniques can be performed with the right or left hand. With any of these techniques, the massage device can be rotated 180 degrees in the hand in order to switch from a side to side to an up and down motion.

When using the handle as a trigger point release tool, the massage device is inverted and the rollers are gripped. The curve of the handle can now be pressed into the tissue to release the trigger point. An alternative to the two-handed grip is to span and grip both rollers with one hand.

The massage device described herein can perform various massage functions. Following are a few examples of ways in which the massage device may be used. These are illustrative examples and are not intended to be all inclusive. The use of the massage device can be adapted as desired.

General Body Massage and Myofascial Release:

Divide the body into sections and massage a small portion at a time. Using a horse as an example, start with the horse's neck, hold the massage device in a comfortable hand position, press with moderate force and roll back and forth in a rhythmic manner four or so times. Roll the massage device to an adjacent area and repeat the process, slightly overlapping the prior area. Repeat this section by section, i.e. from neck to withers to the back, the hind end, etc. The rhythm, pressure and rolling speed should be consistent. The rolling speed may be approximately one foot per second, however both speed and pressure can be adjusted to suit as some horses (or dogs or people) prefer more or less contact.

When resistance or tension is felt while rolling, this spot may require additional attention. Roll in a smaller area on that spot with a continued gentle, soothing rolling motion. Roll the affected spot in both horizontal and vertical directions. For example, four rolls in a horizontal direction, then four rolls in a vertical direction. When the massage device rolls freely again, the tension has been released. Continue on with the massage.

Trigger Point Release:

When resistance or tension is felt during a gentle rolling massage, this can indicate that a trigger point has been found. To use the trigger point tool, turn the massage device over and, holding it by the rollers, use the top of the handle to gently press into that area. Gently, slowly press until resistance is felt, hold for six to ten seconds then slowly release the pressure. Move the device one handle width to the right and repeat. Move the device one handle width below and repeat. Move the device one handle width to the left and repeat. This forms a square of releasing pressure that aids and encourages the release of tension that is held in the tissue.

Acupressure Treatment:

This will encourage relaxation and release of tension. Gently roll along a meridian, such as the bladder meridian for a horse. This meridian begins at the poll (top of the neck) and continues down the neck, along the top line high on the back, around the hind end and down the rear leg to the hoof.

Roll slowly and with gentle pressure along the whole length of the meridian. Watch the horse for reactions, as this can signal that a trigger point has been found. When one is found, either stop at that area or return to it after the full meridian is done and use the technique as described above for trigger point release. The trigger point technique can also be used to target specific acupressure points as desired.

While various arrangements of the innovation have been particularly shown and described, it will be understood by those skilled in the art that various changes in form and details may be made therein without departing from the spirit and scope of the innovation as defined by the appended claims.

The invention claimed is:

1. A massage device, comprising:

a roller body; and a first roller set and a second roller set disposed on the roller body and arranged in a fore and aft position, the first roller set and the second roller set configured to be rolled along a tissue such that the first roller set makes a first contact that compresses a front tissue portion relative to the first roller set and extends a rear tissue portion relative to the first roller set, the second roller set makes a second contact that compresses a front tissue portion relative to the second roller set and extends a rear tissue portion relative to the second roller set, The massage device further comprising a handle coupled to the roller body, the handle comprising:

a grasping portion, the grasping portion defining a curved grasping geometry on a first side of the grasping portion, a surface on a second side of the grasping portion defining a wall thickness between the first side and the second side, said second surface substantially following the curved geometry of the first side, creating a hollow grasping volume, a protrusion extending inwardly from an outer perimeter of said second surface of the grasping portion, and continuing around a perimeter of the grasping portion, forming a brim, and a standoff portion extending from the second side of the grasping portion, the standoff portion coupled to the roller body.

2. The massage device of claim 1, wherein:

the first roller set and the second roller set are spaced apart so that the tissue remains one of compressed and extended between the first contact of the first roller set and the second contact of the second roller set.

3. The massage device of claim 2, wherein the first roller set and the second roller set are spaced apart within the range of 1.1 to 4.0 roller diameters.

4. The massage device of claim 2, wherein the first roller set and the second roller set are spaced apart within the range of 1.5 to 2.0 roller diameters.

5. The massage device of claim 1, wherein:

the first roller set comprises one or more first rollers disposed on a first roller shaft of the roller body and the second roller set comprises one or more second rollers disposed on a second roller shaft of the roller body, each roller of the first roller set extending along a longitudinal axis of the first roller shaft and each roller of the second roller set extending along a longitudinal axis of the second roller shaft, the first roller set defining a substantially continuous first contact surface along the longitudinal axis of the first roller shaft and the second roller set defining a substantially continuous second contact surface along the longitudinal axis of the second roller shaft.

6. The massage device of claim 5, wherein a longitudinal gap of the substantially continuous first contact surface and the substantially continuous second contact surface is within the range of 0.0 to 0.38 inches.

7. The massage device of claim 5, wherein a longitudinal gap of the substantially continuous first contact surface and the substantially continuous second contact surface is within the range of 0.0 to 0.25 inches.

8. The massage device of claim 1, wherein a roller material that extends about an outer periphery of at least one of the first roller set and the second roller set comprises an elastomeric material.

9. The massage device of claim 1, wherein the protrusion extending inwardly from the lower edge of said second surface of the grasping portion, and continuing around the perimeter of the grasping portion defines a radius.

10. The massage device of claim 1, further comprising a third roller set disposed on the roller body, the third roller set configured to be rolled along the tissue such that the third roller set makes a third contact that displaces the tissue, and wherein the second roller set and the third roller set are spaced apart so that the tissue remains one of compressed and extended between the second contact of the second roller set and the third contact of the third roller set.

11. The massage device of claim 1, wherein the grasping portion defines a square perimeter, each corner of the square perimeter defining a rounded corner.

12. The massage device of claim 1, wherein the grasping portion defines a circular perimeter.

13. The massage device of claim 1, wherein the curved grasping geometry defines a constant radius curve.

14. The massage device of claim 1, wherein the curved grasping geometry defines a multi-radius curve, wherein a center portion of the grasping portion comprises a raised section having a smaller radius than that of an outer portion of the handle.

* * * * *